US009032847B2

(12) United States Patent
Duitsman et al.

(10) Patent No.: US 9,032,847 B2
(45) Date of Patent: May 19, 2015

(54) MULTI-BIT POWER DRIVER

(71) Applicants: Timothy L. Duitsman, Naperville, IL (US); Jonathan D. Ginsberg, Buffalo Grove, IL (US); Ismet M. Marinovic, Mansfield, TX (US)

(72) Inventors: Timothy L. Duitsman, Naperville, IL (US); Jonathan D. Ginsberg, Buffalo Grove, IL (US); Ismet M. Marinovic, Mansfield, TX (US)

(73) Assignee: Klein Tools, Inc., Lincolnshire, IL (US)

( * ) Notice: Subject to any disclaimer, the term of this patent is extended or adjusted under 35 U.S.C. 154(b) by 395 days.

(21) Appl. No.: 13/739,942

(22) Filed: Jan. 11, 2013

(65) Prior Publication Data

US 2014/0196580 A1 Jul. 17, 2014

(51) Int. Cl.

| | |
|---|---|
| ***B25B 23/00*** | (2006.01) |
| ***B25B 15/00*** | (2006.01) |
| ***B25B 23/12*** | (2006.01) |

(52) U.S. Cl.

CPC ..... *B25B 23/0035* (2013.01); *B25B 15/001* (2013.01); *B25B 23/0007* (2013.01); *B25B 23/12* (2013.01)

(58) Field of Classification Search

CPC B25B 23/0035; B25B 23/0007; B25B 23/12; B25B 15/001; B25B 15/004; B25B 23/0021; B25B 23/0042

See application file for complete search history.

(56) References Cited

U.S. PATENT DOCUMENTS

| | | | | |
|---|---|---|---|---|
| 3,023,015 | A | 2/1962 | Pankow | |
| 3,114,401 | A * | 12/1963 | Johnson | 81/438 |
| 4,448,097 | A | 5/1984 | Rocca | |
| 4,676,703 | A | 6/1987 | Swanson | |
| 5,450,775 | A | 9/1995 | Kozak | |
| 5,470,180 | A | 11/1995 | Jore | |
| 5,533,429 | A | 7/1996 | Kozak | |
| 5,779,404 | A | 7/1998 | Jore | |
| 5,785,468 | A * | 7/1998 | Peritz | 408/226 |
| 5,881,614 | A | 3/1999 | Cheng-Tsan | |
| 5,893,685 | A | 4/1999 | Olson et al. | |
| 5,894,765 | A | 4/1999 | Anderson et al. | |
| 5,904,080 | A | 5/1999 | Anderson et al. | |
| 5,954,463 | A | 9/1999 | Jore | |
| 6,345,560 | B1 | 2/2002 | Strauch et al. | |
| 6,347,914 | B1 | 2/2002 | Boyle et al. | |
| 6,352,011 | B1 | 3/2002 | Fruhm | |
| 6,354,177 | B2 | 3/2002 | Peters | |
| 6,761,361 | B2 * | 7/2004 | Taylor et al. | 279/75 |
| 7,290,470 | B1 * | 11/2007 | Peters | 81/439 |
| 8,621,961 | B2 * | 1/2014 | Burch et al. | 81/9.4 |
| 2008/0217870 | A1 | 9/2008 | Shibata | |
| 2013/0239755 | A1 * | 9/2013 | Khangar et al. | 81/125 |
| 2014/0015205 | A1 * | 1/2014 | Viuf | 279/46.1 |

FOREIGN PATENT DOCUMENTS

| | | |
|---|---|---|
| DE | 29921197 | 11/2000 |

* cited by examiner

*Primary Examiner* — David B Thomas

(74) *Attorney, Agent, or Firm* — McDonnell Boehnen Hulbert & Berghoff LLP.

(57) ABSTRACT

A tool having a main barrel with an inner cavity, a tool bit holder adapted to be removably secured within the inner cavity, the tool bit holder having a first inner cavity adapted for receiving a first reversible tool bit and a second inner cavity adapted to receive a non-reversible tool bit, wherein the inner cavity of the main barrel serves as a first sized nut driver, the first inner cavity of the tool bit holder serves as a second sized nut driver, and the second inner cavity of the tool bit holder serves as third sized nut driver, where first, second, and third sized nut drivers each have a different size.

38 Claims, 5 Drawing Sheets

MULTI-BIT POWER DRIVER

BACKGROUND

The present embodiments generally relate to tools. More particularly, the present embodiments pertain to a multi-purpose tool holder designed to fit into the handle of a handheld tool, or the chuck of a standard rotary power tool, such as a handheld drill, although it could be also be used as a hand held tool. The multi-purpose tool holder may be referred to as a multi-bit power driver.

Repairmen, technicians, and others are frequently required to carry a variety of tools for the various tasks that they are required to perform. As an example, tradesmen often carry both Phillips head and flat head screwdrivers as a rule. Depending on the application, different sized Phillips head or flat head screwdrivers may even be required. For example, a small screw may require, or be adapted to receive, only a small Phillips head bit, such as size #1 head. Or, the application may involve larger screws that may require, or be adapted to receive, a larger sized Phillips head bit, such as a #2 Phillips head bit. Of course, the same may be true of flat head screws. Different sized flat head bits may be required, depending on the size of the head of the screw. Additionally, other type bits, such as Torx head style bits, may be required for applications involving Torx head screws. In addition, various sized nut drivers may also be required. For example 9/16, 3/8, 5/16, 1/4, and 3/16 sized nut drivers may be needed.

In any event, in order to be prepared to handle the various types of screws and nuts that may be encountered, technicians are required to carry a multitude of tools. Even though some of the screw or nut driver sizes may be used infrequently, technicians still may need to carry all the potential sizes for the screws and nuts that they may encounter, along with all of the other types of tools necessary for their work. It may be difficult and time-consuming for them to gather all of the separate tools that may be needed. It may also be unwieldy and cumbersome to carry all of the tools at the same time that may be required. In addition, it is also costly for a technician to purchase and carry all of the various tools that may be required.

Therefore, it would be desirable if existing screwdriver heads and hex drivers could be combined into a tool to reduce the overall number of tools that a technician may be required to carry. It is known to provide a screwdriver having reversible bits. For example, some screwdrivers include a removable hollow shaft adapted for housing a bit holder on either end thereof. Reversible bits that may have a Phillips head on one end and a slotted end on the other end of the reversible bit may be placed within the bit holder in the screwdriver. The screwdrivers may also include bits of varying sizes to provide greater versatility to the screwdriver. Screwdrivers adapted to accommodate reversible bits are known to have the same sized nut driver on each side of the tool bit holder in order to accommodate reversible bits on both sides of the tool bit holder. As a result, the nut driving capabilities of screwdrivers having a tool holder adapted to accommodate reversible bits on both ends is limited.

In addition, a variety of non-reversible removable bits, typically on the order of one inch of length, have been used with screwdrivers to allow a technician to remove one bit and exchange it for another bit using the same tool holder. There is a need to provide a screwdriving tool that may accommodate both reversible bits and non-reversible bits.

SUMMARY

In one aspect, a tool is provided having a main barrel with an inner cavity located on a first end of the barrel, a tool bit holder adapted to be removably secured within the inner cavity of the main barrel, the tool bit holder having a first inner cavity located on a first end of the tool bit holder, the first inner cavity adapted for receiving a first reversible tool bit, the tool bit holder having a second inner cavity located on a second end of the tool bit holder adapted to receive a non-reversible tool bit, wherein the inner cavity of the main barrel may serve as a first sized nut driver, wherein the first inner cavity of the tool bit holder may serve as a second sized nut driver, wherein the second inner cavity of the tool bit holder may serve as a third sized nut driver, and wherein the first sized nut driver, the second sized nut driver and the third sized nut driver each have a different size.

In a further aspect, tool is provided having a main barrel with an inner cavity located on a first end of the barrel, a tool bit holder adapted to be removably secured within the inner cavity of the main barrel, the tool bit holder having a first inner cavity located on a first end of the tool bit holder, the first inner cavity adapted for receiving a first reversible tool bit, the tool bit holder having a second inner cavity located on a second end of the tool bit holder adapted to receive a non-reversible tool bit, wherein the inner cavity of the main barrel may serve as a first sized nut driver of 9/16 inches or greater, wherein the first inner cavity of the tool bit holder may serve as a second sized nut driver, wherein the second inner cavity of the tool bit holder may serve as a third sized nut driver of 1/4 inch size, and wherein the second sized nut driver is smaller than the first sized nut driver and bigger than the third sized nut driver.

In another aspect, a tool is provided having a main barrel with an inner cavity located on a first end of the barrel, a tool bit holder adapted to be removably secured within the inner cavity of the main barrel, the tool bit holder having a first inner cavity located on a first end of the tool bit holder, the first inner cavity adapted for receiving a first reversible tool bit, the tool bit holder having a second inner cavity located on a second end of the tool bit holder adapted to receive a non-reversible tool bit, wherein the inner cavity of the main barrel may serve as a first sized nut driver of 3/8 inches or greater, wherein the first inner cavity of the tool bit holder may serve as a second sized nut driver, wherein the second inner cavity of the tool bit holder may serve as a third sized nut driver.

BRIEF DESCRIPTION OF THE DRAWINGS

Exemplary embodiments of the invention are described herein with reference to the drawings, wherein like parts are designated by like reference numerals, and wherein.

DETAILED DESCRIPTION

Figure 1:
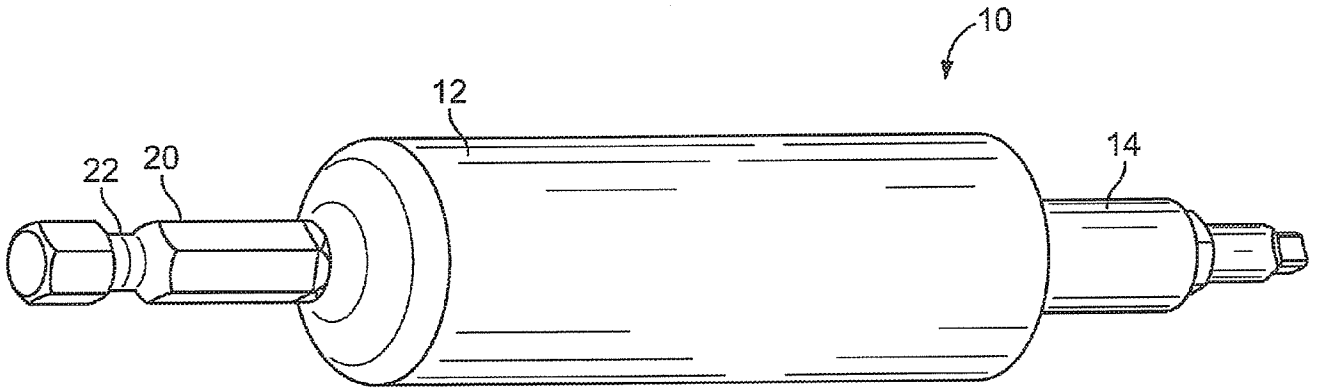
FIG. 1 is a perspective view of tool 10 shown with a tool bit holder 14 extending from a first end and a shank extending from a second end.

FIG. 1 is a perspective view of tool 10 having a tool bit holder 14 extending from a first end of main barrel 12 and a shank 20 extending from a second end of main barrel 12. The shank 22 may be positioned in the chuck of a rotary tool such as a drill. Groove 22 on shank 20 may allow the tool 10 to be securely held within the chuck of a rotary tool. Tool bit holder 14 is adapted to removably receive tool bits such that tool 10 may function as a multi-bit power driver. In addition, the outer surface of main barrel 12 could be formed as a gripping handle such that tool 10 could be used as a hand tool, in which case shank 20 would be unnecessary. Thus, tool 10 may be used as a multi-bit power driver that is positioned in, and driven by, a rotary power tool such as a drill, or may be used as a hand tool that is turned by hand.

Figure 2:
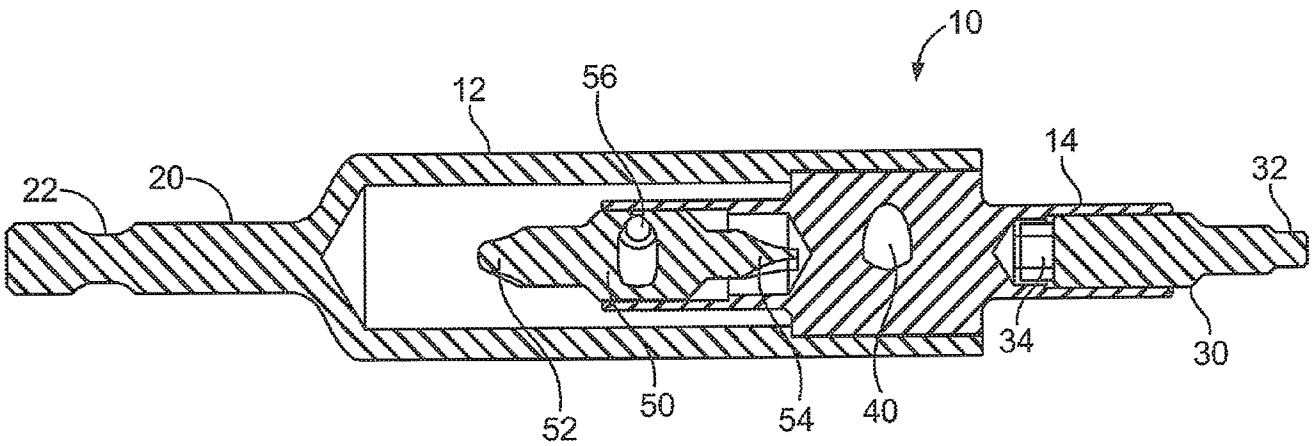
FIG. 2 is a cross-sectional view of the tool 10 shown in FIG. 1.

Further details of tool 10 are disclosed in FIG. 2 which provides a cross-sectional view of the tool 10 shown in FIG. 1. In particular, tool bit holder 14 is shown removably secured within a first end of main barrel 12. The tool bit holder 14 may be secured within main barrel 12 using a ball and detent arrangement 40, or other suitable means of retaining tool bit holder 14 within main barrel 12, including press fit. A reversible bit 50 is shown positioned within a first end of the tool bit holder 12. Reversible bit 50 is shown having a first bit 52 on a first end of the reversible bit and a second bit 54 on a second end of the reversible bit 50. The bits 52 and 54 are preferably different size or type bits. For example, bit 52 could be a Phillips head and bit 54 could be a flat head bit. Reversible bit 50 is removably secured within the first end of the tool bit holder 14 with a ball and detent mechanism 56, although other suitable means of retaining the reversible bit 50 within the first end of tool bit holder 14 could also be used, including a press fit.

A non-reversible bit 30 is shown removably secured within, and extending from, a second end of tool bit holder 14, and from the first end of main barrel 12. Non-reversible bit 30 with bit end 32 is shown held within the second end of tool bit holder 14 with a magnet 34 positioned in the base of the cavity in the second end of tool bit holder 14. A rare earth magnet that is 0.220 inches in diameter and 0.130 thick and that may be either toroidal or disc shaped may be used. It should be noted that while the use of a magnet is a preferred way of removably securing the non-reversible bit 30 within the cavity, a magnet is required, and other suitable ways of removing securing the non-reversible bit 30 within the cavity may be used, such as a ball and socket, ball and detent, spring, press fit, etc. Non-reversible bit 30 has a bit end 32 which could be any number of different sized or shaped bit ends. In this example a square head bit is shown, although it could be a variety of other known bit ends including a Phillips head, a flat head, a Torx end, or other known bit ends. If a different bit end is desired, non-reversible bit 34 may simply be removed, and replaced with another non-reversible bit having a desired bit end.

In addition, if it is desired to use the bits of reversible bit 50, the tool bit holder 14 may be simply removed from main barrel 12 and rotated 180 degrees, such that the second end of the tool bit holder holding non-reversible bit 30 is positioned within the main barrel 12, and the reversible bit 50 extends from the main barrel 12.

The tool bit holder 14 advantageously provides a first end adapted to receive reversible tool bits. For example, reversible tool bit 50 may be removed and replaced with another reversible tool bit to provide the desired bit ends. Thus, the tool bit holder may be used with a variety of different reversible bits. In addition, tool bit holder 14 advantageously provides a second end that is adapted to receive non-reversible bit ends that may be held in place with a magnet. Thus, non-reversible bit 30 may be removed and replaced with another non-reversible tool bit to provide a desired bit end. For example, a non-reversible bit end with a Phillips head could be removed and replaced with a non-reversible bit with a flat head.

Thus, tool bit holder 14 may advantageously accommodate both reversible bits and non-reversible bits. Therefore, if a technician is in possession of only non-reversible bits, the tool bit holder 14 can utilize those non-reversible bits. Similarly, if a technician is in possession of only reversible bits, the tool bit holder 14 can also utilize those reversible bits. In a preferred embodiment, the reversible bit 50 and non-reversible bit 30 are comprised of S2 steel.

When the tool bit holder 14 is removed from main barrel 12, the inner cavity at the first end of the main barrel 12 may serve as a first nut driver. As shown in FIG. 6, the first end 70 of main barrel 12 may serve as first nut driver ND1. In the embodiments shown in FIGS. 1-6, the first nut driver ND1 is 9/16 inch or larger.

Figure 3:
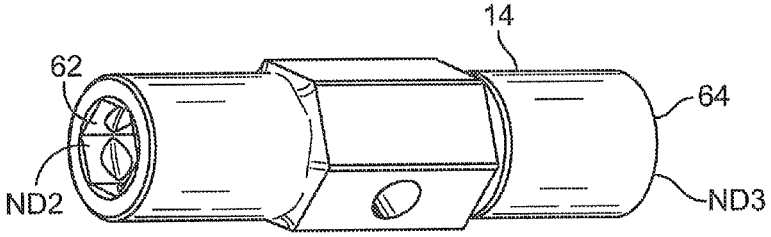
FIG. 3 is a perspective view of the tool bit holder 14 shown in FIGS. 1 and 2.

FIG. 3 is a perspective view of tool bit holder 14 with the reversible bit 50 and non-reversible bit 30 removed. The first end 62 of tool bit holder 14 has a first inner cavity that may serve as a second nut driver ND2. In addition, the second end 64 of the tool bit holder 14 has a second inner cavity that may serve as a third nut driver ND3.

Figure 4A:
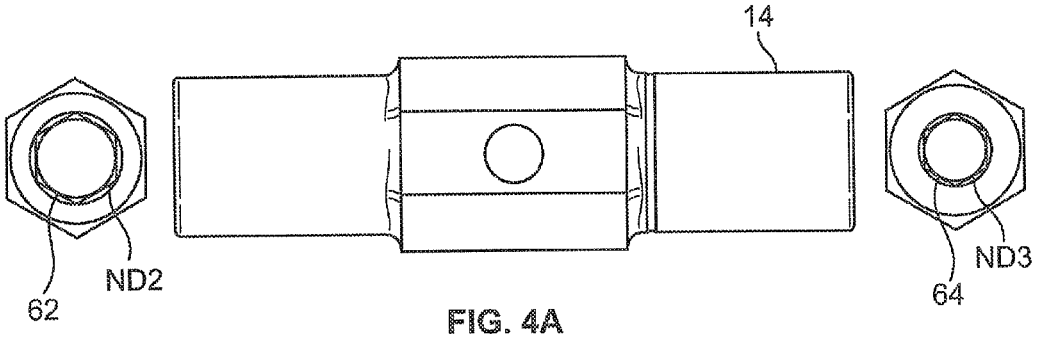
FIG. 4A includes a front view, left side view, and right side view of the tool bit holder shown in FIG. 3.

FIG. 4A provides a front view, left side view, and right side view of tool bit holder 14 shown in FIG. 3. First end 62 includes second nut driver ND2 and second end 64 includes third nut driver ND3. ND2 and ND3 are preferably of different sizes to provide greater nut driving functionality to the tool. In a preferred embodiment, ND2 is greater in size than ND3, and in the embodiment shown in FIGS. 1-3, ND2 is a 5/16 inch nut driver and ND3 is a 1/4 inch nut driver. The tool bit holder 14 has an outer surface adapted to be received within the first end 70 of main barrel 12 where ND1 is a 9/16 inch nut driver. With this design, a technician is advantageously provide with three different sized nut drivers—9/16 inch, 5/16 inch, and 1/4 inch nut drivers.

Figure 4B:
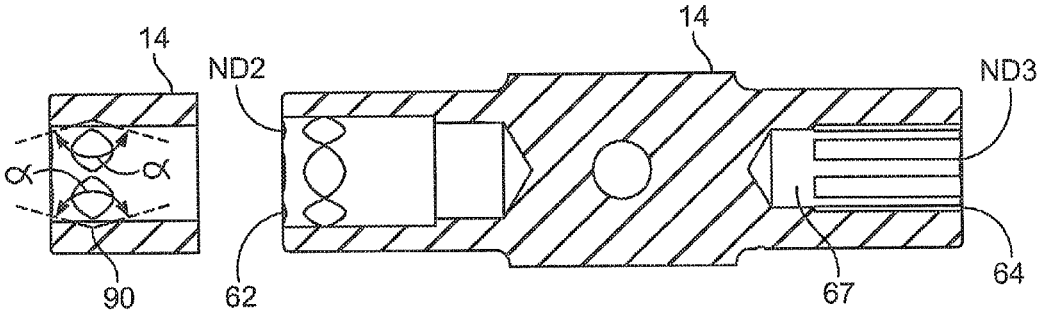
FIG. 4B is cross-sectional view of the tool bit holder shown in FIGS. 3 and 4A.

FIG. 4B is a cross-sectional view of tool bit holder 14 shown in FIGS. 3 and 4A. The second nut driver ND2 on the first end 62 of tool bit holder 14 is shown to be of a larger size than the third nut driver ND3 on the second end 64 of tool bit holder 14. As noted above, in a preferred embodiment, ND2 is a 5/16 nut driver and ND3 is a 1/4 inch nut driver, and the outer surface of tool bit holder 14 is adapted to be removably secured within the main barrel 12 of tool 10 where ND1 is a 9/16 nut driver.

An inner surface of first end 62 of tool bit holder 14 includes a groove 90 that is adapted to receive the ball from the ball and detent mechanism 56 (See FIG. 2) positioned on the outer surface of reversible bit 50 to secure the reversible bit 50 within the first end 62 of tool bit holder 14. The addition of groove 90 provides even greater retaining strength than if the ball and detent mechanism 56 on reversible bit 50 were used alone to secure the reversible bit 50 within the tool bit holder 14. In a preferred embodiment, the depth of groove 90 is on the order of 0.018 to 0.020 inches where the groove is comprised of two opposed surfaces positioned at an angle $\alpha$ of between 140-155 degrees, and most preferably between 145-147 degrees. Even where the groove 90 is positioned, the wall thickness is preferably a minimum of 0.038 inches to provide the strength required to handle the forces applied to the nut driver when a nut is driven.

Figure 5:
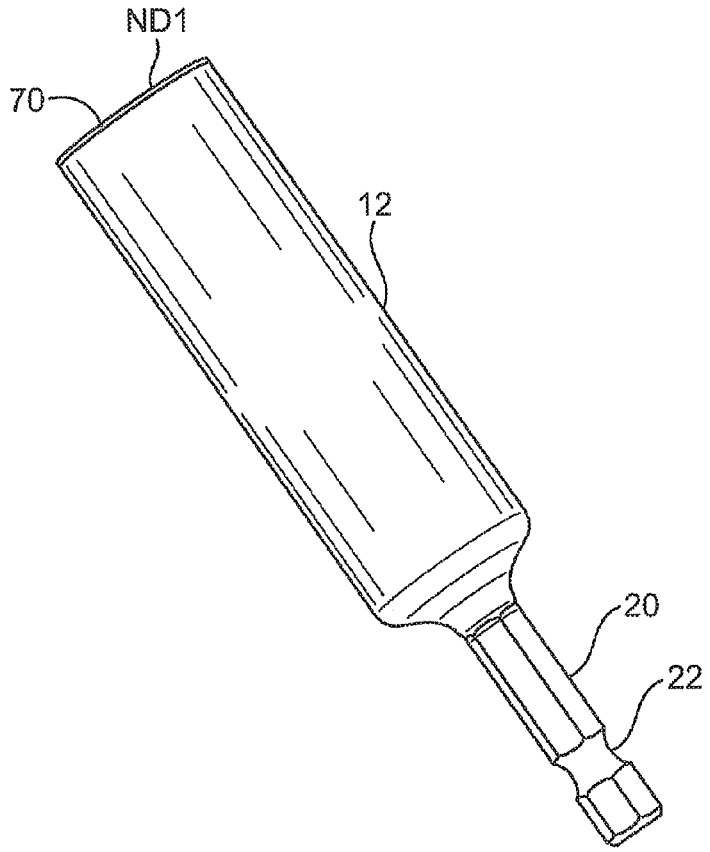
FIG. 5 is a perspective view of the main barrel 12 of the tool 10 shown in FIGS. 1 and 2.
Figure 6:
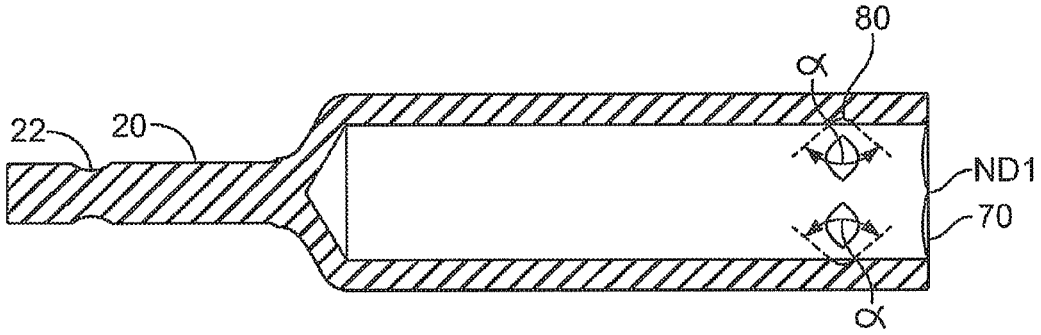
FIG. 6 is a cross-sectional view of the main barrel 12 shown in FIG. 5.

FIG. 5 is a perspective view of main barrel 12 shown in FIGS. 1 and 2. Main barrel 12 has a first end 70 having an inner cavity that forms the first nut driver ND1. The second end of main barrel 12 includes a shank 20 and external groove 22 that is adapted to be received into a chuck of a rotary tool, such as a drill. FIG. 6 is a cross-sectional view of the main barrel 12 shown in FIG. 5. The cavity on the first end 70 has an inner cavity that forms the first nut driver ND1. The inner cavity of first end 70 is adapted to receive the tool bit holder 14 shown in FIGS. 3, 4A, and 4B.

An inner surface of first end 70 includes a groove 80 that is adapted to receive the ball from the ball and detent mechanism 40 (See FIG. 2) positioned on the outer surface of tool bit holder 14 to secure the tool bit holder 14 within the main barrel 12. The addition of groove 80 provides even greater retaining strength than if the ball and detent mechanism 40 on tool bit holder 14 were used alone to secure the tool bit holder 14 within the main barrel 12. In a preferred embodiment, the depth of groove 80 is on the order of 0.019 to 0.020 inches where the groove is comprised of two opposed surfaces positioned at an angle $\alpha$ of between 140-155 degrees, and most preferably between 145-147 degrees. Even where the groove 80 is positioned, the wall thickness is preferably a minimum of 0.038 inches to provide the strength required to handle the forces applied to the nut driver when a nut is driven.

Some prior screwdrivers that include nut driver functionality have failed to provide nut drivers of sufficient strength to withstand the torque and forces that may be imparted thereon during the driving of a nut, and have become stripped as a result. The present embodiments provide a tool with three different sized nut drivers where the nut drivers have sufficient strength to withstand the torque and forces that may be imparted when a nut is driven, for example when a hex head bolt is driven. In one embodiment, the tool bit holder 14 is comprised of 4140 steel. The tool bit holder 14 is also provided with a hardness of between 44-48 HRC inclusive, meaning that it includes both 44 and 48 HRC. Similarly, in a preferred embodiment, the main barrel 12 is comprised of 4140 steel with hardness of between 44-48 HRC inclusive.

In addition, each of the nut drivers ND1, ND2, and ND3 is provided with a minimum wall thickness of 0.038 inches, even where a groove 80 or groove 90 is present. A tool bit holder 14 with nut drivers ND1, ND2, and ND3 with these properties has been found to provide nut drivers with sufficient strength to handle the torque and forces imparted during the driving of a nut.

Moreover, the tool and tool bit holder shown in FIGS. 1-4B with three different sized nut drivers, ND1, ND2, and ND3 with ND1 sized as a 9/16 inch nut driver and with ND2 sized as a 5/16 inch nut driver where both ND1 and ND2 have a minimum wall thickness of 0.038 inches, even where groove 80 or groove 90 is positioned, has not been previously achieved. In addition, the present embodiments may advantageously include a tool having three different sized nut drivers, ND1, ND2, and ND3 with ND1 sized as a 9/16 inch nut driver, with ND2 sized as a 5/16 inch nut driver, and with ND3 sized as a 1/4 inch nut driver to provide technicians with increased nut driver functionality. In addition to the increased nut driver functionality, the embodiments described also have the benefit of accommodating both reversible tool bits and non-reversible tool bits to provide an even greater breadth of functionality to the tool. A multi-bit power driver having these features has also not been previously achieved.

Figure 7:
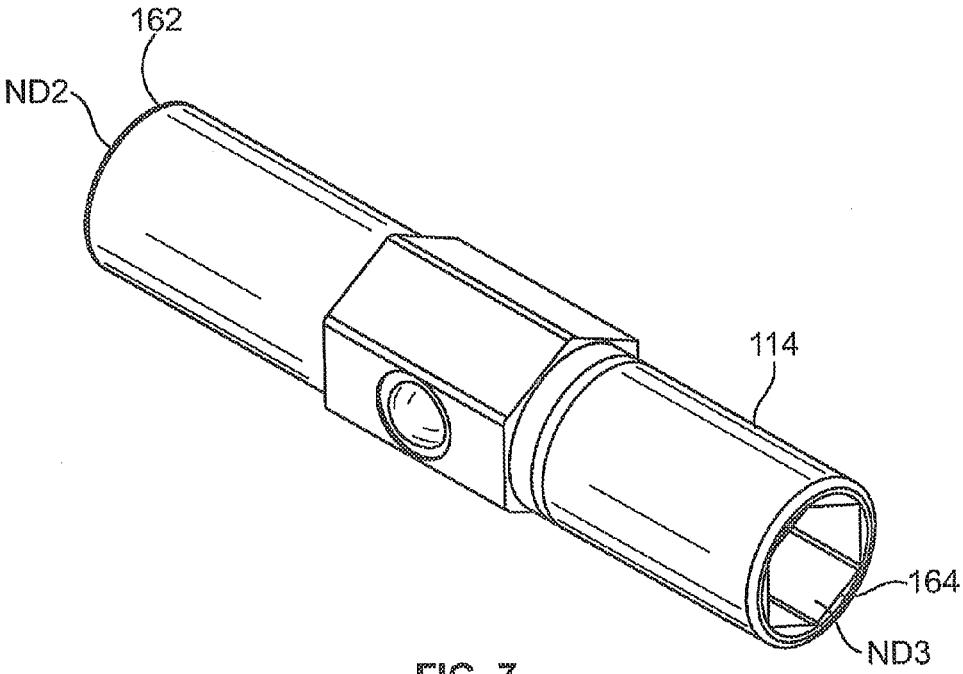
FIG. 7 is perspective view of another tool bit holder 114 that could be used with the present embodiments.

FIG. 7 is shows a slightly different tool bit holder 114 that is adapted to fit into a smaller main barrel having a cavity that forms a 3/8 inch size nut driver. Tool bit holder 114 has a first end 162 that has inner cavity the forms a second nut driver ND2 and a second end 164 with an inner cavity that forms a third nut driver ND3.

Figure 8A:
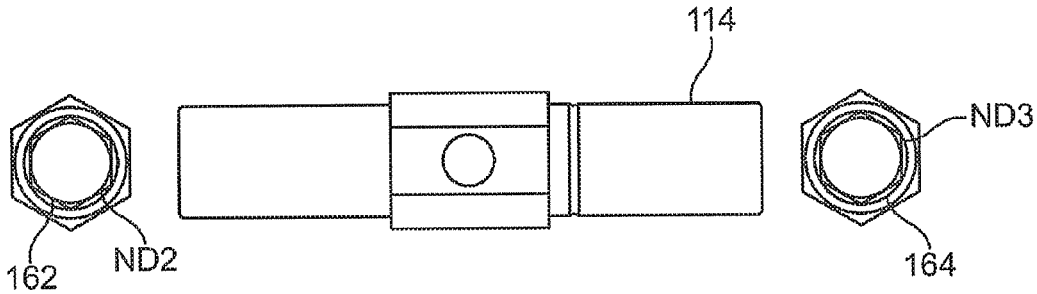
FIG. 8A includes a front view, left side view, and right side view of the tool bit holder shown in FIG. 7.

FIG. 8A provides a front view, left side view, and right side view of tool bit holder 114 shown in FIG. 7. First end 162 includes second nut driver ND2 and second end 164 includes third nut driver ND3. ND2 and ND3 are preferably the same size. In a preferred embodiment, ND2 is a 1/4 inch nut driver and ND3 is a 1/4 inch nut driver. The tool bit holder 114 has an outer surface adapted to be received within the first end 70 of main barrel 12 where ND1 is a 3/8 inch nut driver.

Figure 8B:
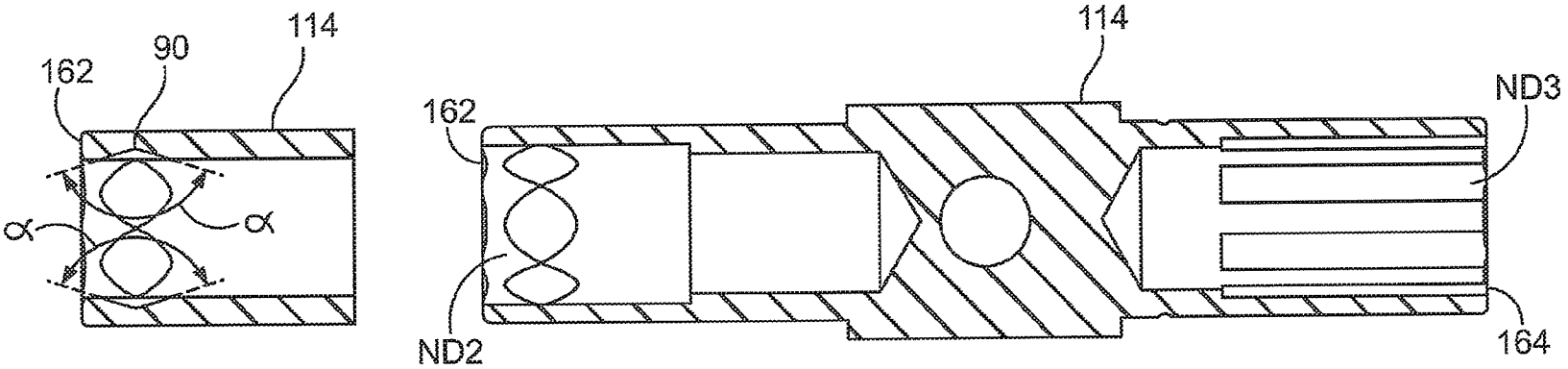
FIG. 8B is a cross-sectional view of the tool bit holder 114 shown in FIGS. 7 and 8A.

FIG. 8B is a cross-sectional view of tool bit holder 114 shown in FIG. 7. Nut driver ND2 is adapted to receive a reversible tool bit that may be removably secured within the first end 162 with a ball and detent mechanism on the reversible bit. Nut driver ND3 is adapted to receive a non-reversible tool bit that may be held in place via a magnet positioned within the base of the inner cavity formed in the second end 164 of tool bit holder 114. A rare earth magnet that is 0.220 inches in diameter and 0.130 thick and that may be either toroidal or disc shaped may be used. It should be noted that while the use of a magnet is a preferred way of removably securing the non-reversible bit 30 within the cavity, a magnet is required, and other suitable ways of removing securing the non-reversible bit 30 within the cavity may be used, such as a ball and socket, ball and detent, spring, press fit, etc.

In a preferred embodiment, ND2 and ND3 are the same size nut driver. In a most preferred embodiment, ND2 and ND3 are 1/4 inch nut drivers that have a minimum wall thickness of 0.038 inches, even when a groove is present, to provide sufficient strength to withstand the torque and forces that are applied when a nut is driven. In one embodiment, the tool bit holder 114 is comprised of 8650 steel. The tool bit holder 114 is also provided with a hardness of between 44-48 HRC inclusive, meaning that it includes both 44 and 48 HRC. Similarly, in a preferred embodiment, the main barrel that is used in conjunction with tool bit holder 114 is comprised of 4140 steel with hardness of between 44-48 HRC inclusive.

As shown in FIG. 8B, an inner surface of first end 162 of tool bit holder 114 includes a groove 90 that is adapted to receive the ball from the ball and detent mechanism 56 (See FIG. 2) positioned on the outer surface of reversible bit 50 to secure the reversible bit 50 within the first end 62 of tool bit holder 14. The addition of groove 90 provides even greater retaining strength than if the ball and detent mechanism 56 on reversible bit 50 were used alone to secure the reversible bit 50 within the tool bit holder 14. In a preferred embodiment, the depth of groove 90 is on the order of 0.018 to 0.020 inches where the groove is comprised of two opposed surfaces positioned at an angle $\alpha$ of between 140-155 degrees, and most preferably between 145-147 degrees. Even where the groove 90 is positioned, the wall thickness is preferably a minimum of 0.038 inches to provide the strength required to handle the forces applied to the nut driver when a nut is driven.

The embodiments shown in FIGS. 7, 8A, and 8B may provide for a tool having a 3/8 sized nut driver ND1 formed by a cavity in the main barrel having a removable tool bit holder 114 with a 1/4 inch sized nut driver ND2 adapted to receive a reversible tool bit and a 1/4 inch sized nut driver ND3 adapted to receive a non-reversible bit. A tool constructed in this manner that has sufficient strength to withstand the torque imparted when a nut is repeatedly driven, and adapted to receive both reversible bits and non-reversible bits has not heretofore been achieved.

Example embodiments of the present embodiments have been described above. Those skilled in the art will understand that changes and modifications may be made to the described embodiments without departing from the true scope and spirit of the present invention, which is defined by the claims.

We claim:

1. A tool comprising:

a main barrel with an inner cavity located on a first end of the barrel;

a tool bit holder adapted to be removably secured within the inner cavity of the main barrel;

the tool bit holder having a first inner cavity located on a first end of the tool bit holder, the first inner cavity adapted for receiving a first reversible tool bit;

the tool bit holder having a second inner cavity located on a second end of the tool bit holder, the second cavity adapted to receive a non-reversible tool bit;

wherein the inner cavity of the main barrel may serve as a first sized nut driver;

wherein the first inner cavity of the tool bit holder may serve as a second sized nut driver;

wherein the second inner cavity of the tool bit holder may serve as a third sized nut driver; and wherein the first sized nut driver, the second sized nut driver and the third sized nut driver each have a different size.

2. The tool of claim 1, wherein the second sized nut driver is larger than the third sized nut driver.

3. The tool of claim 2, wherein the second sized nut driver is a 5/16 inch size nut driver and the third sized nut driver is a ¼ inch nut driver.

4. The tool of claim 3, wherein the first sized nut driver is 9/16 inch or larger.

5. The tool of claim 3, wherein the first sized nut driver is a 9/16 inch nut driver.

6. The tool of claim 3, wherein the second sized nut driver has a wall thickness that is at least 0.038 inches.

7. The tool of claim 2, wherein the third sized nut driver is a ¼ inch nut driver.

8. The tool of claim 2, wherein the tool bit holder has a ball and detent on an outer surface thereof.

9. The tool of claim 8, wherein an inner surface of the main barrel has a groove adapted to receive the ball of the tool bit holder.

10. The tool of claim 9, wherein the groove on the inner surface of the main barrel has a depth of 0.019 to 0.020 inches and surfaces extending at an angle of between 145 to 150 degrees.

11. The tool of claim 2, wherein the first reversible bit has one end that is first sized Phillips head driver, and the non-reversible bit has an end that is a second sized Phillips head driver that is smaller than the first sized Phillips head driver.

12. The tool of claim 1, wherein an outer surface of the main barrel serves as a gripping handle.

13. The tool of claim 1, wherein a shank extends from a second end of the main barrel, where the shank is adapted to be received in a chuck of a rotary power tool.

14. The tool of claim 1, wherein the second inner cavity of the tool bit holder has a magnet positioned in a base thereof, where the magnet is adapted to engage and removably secure the first non-reversible tool bit within the second inner cavity.

15. The tool of claim 14, wherein the first non-reversible tool bit has a flat base that is adapted to contact a corresponding flat surface on the magnet positioned in the base of the second inner cavity of the tool bit holder.

16. The tool of claim 1, wherein the tool bit holder has a hardness of 44-48 HRC inclusive.

17. The tool of claim 16, wherein the tool bit holder is comprised of 4140 steel.

18. A tool comprising:

a main barrel with an inner cavity located on a first end of the barrel;

a tool bit holder adapted to be removably secured within the inner cavity of the main barrel;

the tool bit holder having a first inner cavity located on a first end of the tool bit holder, the first inner cavity adapted for receiving a first reversible tool bit;

the tool bit holder having a second inner cavity located on a second end of the tool bit holder, the second cavity adapted to receive a non-reversible tool bit;

wherein the inner cavity of the main barrel may serve as a first sized nut driver of 9/16 inches or greater;

wherein the first inner cavity of the tool bit holder may serve as a second sized nut driver, wherein the second inner cavity of the tool bit holder may serve as a third sized nut driver of ¼ inch size; and wherein the second sized nut driver is smaller than the first sized nut driver and bigger than the third sized nut driver.

19. The tool of claim 18, wherein the second sized nut driver is a 5/16 inch size nut driver.

20. The tool of claim 18, wherein the second sized nut driver has a wall thickness that is at least 0.038 inches.

21. The tool of claim 18, wherein the tool bit holder a hardness of 44-48 HRC.

22. The tool of claim 21, wherein the tool bit holder is comprised of 4140 steel.

23. The tool of claim 18, wherein the second inner cavity of the tool bit holder has a magnet positioned in a base thereof, where the magnet is adapted to engage and removably secure the first non-reversible tool bit within the second inner cavity.

24. A tool comprising:

a main barrel with an inner cavity located on a first end of the barrel;

a tool bit holder adapted to be removably secured within the inner cavity of the main barrel;

the tool bit holder having a first inner cavity located on a first end of the tool bit holder, the first inner cavity adapted for receiving a first reversible tool bit;

the tool bit holder having a second inner cavity located on a second end of the tool bit holder, the second cavity adapted to receive a non-reversible tool bit;

wherein the inner cavity of the main barrel may serve as a first sized nut driver of ⅜ inches or greater;

wherein the first inner cavity of the tool bit holder may serve as a second sized nut driver, wherein the second inner cavity of the tool bit holder may serve as a third sized nut driver.

25. The tool of claim 24, wherein the second sized nut driver is the same size as the third sized nut driver.

26. The tool of claim 25, wherein the second sized nut driver is a ¼ inch nut driver and the third sized nut driver is a ¼ inch nut driver.

27. The tool of claim 26, wherein the first sized nut driver is a ⅜ inch sized nut driver.

28. The tool of claim 26, wherein the tool bit holder has a hardness of 44-48 HRC inclusive.

29. The tool of claim 28, wherein the tool bit holder is comprised of 8650 steel.

30. The tool of claim 24, wherein the tool bit holder has a ball and detent on an outer surface thereof.

31. The tool of claim 30, wherein an inner surface of the main barrel has a groove adapted to receive the ball of the tool bit holder.

32. The tool of claim 31, wherein the groove on the inner surface of the main barrel has a depth of 0.019 to 0.020 inches and surfaces extending at an angle of between 140 to 155 degrees.

33. The tool of claim 32, wherein the angle is 145 to 147 degrees.

34. The tool of claim 24, wherein an inner surface of the first end of the tool bit holder has a groove adapted to receive a ball positioned on the reversible bit.

35. The tool of claim 34, wherein the groove on the inner surface of the main barrel has a depth of 0.018 to 0.020 inches and surfaces extending at an angle of between 140 to 155 degrees.

36. The tool of claim 35, wherein the angle is 145 to 147 degrees.

37. The tool of claim 35, wherein the second sized nut driver on the tool bit holder has a wall thickness that is at least 0.038 inches.

38. The tool of claim 24, wherein the second inner cavity of the tool bit holder has a magnet positioned in a base thereof, where the magnet is adapted to engage and removably retain the first non-reversible tool bit within the second inner cavity.

* * * * *